US009499935B2

(12) United States Patent
James et al.

(10) Patent No.: US 9,499,935 B2
(45) Date of Patent: Nov. 22, 2016

(54) IRON

(75) Inventors: Mike James, Rotherham (GB); Jamie Michael Sellors, Rotherham (GB); George Ralph Adkins, Rotherham (GB); Richard Gregory, Cambridge (GB)

(73) Assignee: Morphy Richards Limited, South Yorkshire (GB)

( * ) Notice: Subject to any disclaimer, the term of this patent is extended or adjusted under 35 U.S.C. 154(b) by 0 days.

(21) Appl. No.: 13/321,727

(22) PCT Filed: May 19, 2010

(86) PCT No.: PCT/GB2010/001010

§ 371 (c)(1),
(2), (4) Date: Nov. 21, 2011

(87) PCT Pub. No.: WO2010/133844

PCT Pub. Date: Nov. 25, 2010

(65) Prior Publication Data

US 2012/0061372 A1 Mar. 15, 2012

(30) Foreign Application Priority Data

May 22, 2009 (GB) ..... 0908860.0
Aug. 19, 2009 (GB) ..... 0914503.8

(51) Int. Cl.
*D06F 75/38* (2006.01)
*D06F 75/10* (2006.01)
*D06F 75/24* (2006.01)

(52) U.S. Cl.
CPC ..... *D06F 75/24* (2013.01); *D06F 75/38* (2013.01)

(58) Field of Classification Search
CPC ..... D06F 75/38; D06F 75/34; D06F 79/026; D06F 75/36; D06F 75/30; D06F 75/10; D06F 75/20; D06F 75/12; D06F 75/22; D06F 73/00; D06F 75/08; D06F 75/14; D06F 75/16; D06F 75/18; D06F 75/24; D06F 75/26; D06F 79/00; D06F 79/02; D06F 81/06; H01C 7/008; H01C 1/14; H01C 7/18; H01C 10/00; H01C 1/148; H01C 7/00
USPC ..... 219/244–259; 38/74–78; 392/432, 435
See application file for complete search history.

(56) References Cited

U.S. PATENT DOCUMENTS 2,564,706 A 8/1951 Mochel
3,906,187 A * 9/1975 Turoczi, Jr. ..... 219/254
4,016,663 A * 4/1977 Cline et al. ..... 38/77.83

(Continued)

FOREIGN PATENT DOCUMENTS

CN 2615182 Y 5/2004
CN 201598510 U 10/2010

(Continued)

OTHER PUBLICATIONS

EP0891118A1_1_Translation.*

*Primary Examiner* — Eric Stapleton
(74) *Attorney, Agent, or Firm* — Harness, Dickey & Pierce P.L.C.

(57) ABSTRACT

The invention relates to an electrical iron. An iron comprises a sole plate (1), of a glass or ceramic substrate bearing an electrical heating element. The electrical heating element comprises a transparent or translucent antimony tin oxide thin film which directly heats the glass or ceramic substrate.

3 Claims, 15 Drawing Sheets

(56) References Cited

U.S. PATENT DOCUMENTS

| | | | | | |
|---|---|---|---|---|---|
| 4,117,612 | A | * | 10/1978 | Baumgartner et al. | 38/91 |
| 4,122,615 | A | * | 10/1978 | Baumgartner et al. | 38/93 |
| 4,449,035 | A | * | 5/1984 | Schwob | 219/251 |
| 4,602,238 | A | * | 7/1986 | Furtek | 338/236 |
| 4,659,906 | A | * | 4/1987 | Furtek | 392/435 |
| 4,774,395 | A | * | 9/1988 | Yabuuchi et al. | 392/399 |
| 4,835,363 | A | * | 5/1989 | Hoffmann | 219/258 |
| 4,859,869 | A | * | 8/1989 | Heuwinkel et al. | 307/117 |
| 4,889,974 | A | | 12/1989 | Auding et al. | |
| 5,323,550 | A | * | 6/1994 | Taylor et al. | 38/82 |
| 5,367,799 | A | * | 11/1994 | Wilson et al. | 38/77.7 |
| 5,392,542 | A | * | 2/1995 | Chang | 38/93 |
| 5,444,228 | A | * | 8/1995 | Gelus | 219/549 |
| 5,664,349 | A | * | 9/1997 | White et al. | 38/97 |
| 5,777,297 | A | * | 7/1998 | Gelus et al. | 219/254 |
| 5,780,812 | A | * | 7/1998 | Klinkenberg | 219/251 |
| 5,804,791 | A | * | 9/1998 | Gelus | 219/245 |
| 6,054,690 | A | * | 4/2000 | Petit et al. | 219/528 |
| 6,125,234 | A | * | 9/2000 | de Jenlis | 392/439 |
| 6,138,389 | A | * | 10/2000 | Kanazawa et al. | 38/93 |
| 2001/0030183 | A1 | * | 10/2001 | Bowen | 219/246 |
| 2008/0235998 | A1 | * | 10/2008 | Yeung et al. | 38/93 |
| 2009/0114639 | A1 | * | 5/2009 | Werkman et al. | 219/543 |

FOREIGN PATENT DOCUMENTS

| | | | | | |
|---|---|---|---|---|---|
| EP | 0 582 457 | A2 | | 2/1994 | |
| EP | 0713937 | A1 | | 5/1996 | |
| EP | 0891118 | A1 | * | 1/1999 | H05B 3/26 |
| EP | 1 983 097 | A1 | | 10/2008 | |
| FR | 1204207 | | | 1/1960 | |
| FR | 2189562 | | | 1/1974 | |
| GB | 542681 | | | 1/1942 | |
| GB | 1102125 | | | 2/1968 | |
| GB | 2214935 | A | | 9/1989 | |
| WO | 2008/044180 | A2 | | 4/2008 | |
| WO | 2008/101480 | A2 | | 8/2008 | |

* cited by examiner

IRON

CROSS-REFERENCE TO RELATED APPLICATIONS

This application is a 371 U.S. National Stage of International Application No. PCT/GB2010/001010, filed May 19, 2010. This application claims priority to United Kingdom Patent Applications No. GB 0908860.0, filed May 22, 2009 and GB 0914503.8, filed Aug. 19, 2009. The disclosures of the above applications are incorporated herein by reference.

FIELD OF THE INVENTION

The present invention relates to electrical irons.

BACKGROUND TO THE INVENTION

Domestic irons consists of a heated metal sole plate onto which water from a reservoir is dripped to generate steam, which is then emitted through holes in the sole plate. The clothes are then pressed by an action of heat and steam. This method produces a small and varying amount of steam and is really only suitable for small amounts of clothes.

An improvement has been made through the introduction of separate water reservoir and steam generators. In this embodiment, a water tank and steam generator is separate from the iron, which also consists of a heated sole plate. The generated steam is then sent down a pipe to the iron, where a constant stream of steam is then released onto the clothes. This method has the advantage of a large water tank for heavy use and a constant flow of steam. The main disadvantage is that the steam can cool down in the pipe and the system is very inefficient and takes a long time to warm up.

With the latter system, one option would be to pump water up a pipe and generate steam in the iron. However, current nichrome heating technology has a power density limitation, because if the heater becomes too hot, then it will oxidize or burn out. Thus without making the iron much larger and having a dramatic impact on the sole plate temperature, the volume of steam generation is limited. Making the heater separate from the iron allows for a large heater sub-assembly and hence a large rate of steam without the requirement for a large heater power density at the expense of heat up time and efficiency. A further disadvantage of this method is that the steam has to be re-heated at the iron and this can impact on the sole plate temperature at higher flow rates initially when the iron is cold, until the iron is at the correct working temperature. In particular, if a sole plate with poor thermal conductivity is used, then this will become a potentially large problem.

We have therefore appreciated the need for an improved iron and steam generation system.

SUMMARY OF THE INVENTION

According to a first aspect, there is provided an iron comprising a sole plate, the sole plate comprising a glass substrate bearing an electrical heating element. In preferred embodiments, said heating element comprises a substantially transparent film coating of conducting or semi-conducting material.

Preferably, said film coating comprises a semi-conducting oxide, more particularly a doped tin oxide, for example antimony tin oxide ($Sb_3O_4/SnO_2$), fluorine-doped tin oxide or some other substantially transparent conducting doped oxide material. Thus although the use of antimony tin oxide (ATO) film coatings has been found to be especially advantageous due to temperature stability, embodiments of the invention also contemplate substitution of an ATO film coating by a film of a different, electrically conducting material, for example, an alternative substantially transparent conducting oxide film, preferably a tin oxide film, for example Indium Tin Oxide, or a mixture of doped oxides.

Use of a high thermal conductivity material or substrate for the tubes facilitates a relatively low temperature for the heated ATO films, for example less than 200° C.

In embodiments the ATO film coatings are substantially covalently bonded to their substrates, which reduces the risk of lift-off or delamination from the substrate. This can be achieved by cleaning and passivation of the substrate surfaces on which the ATO coatings are deposited.

In embodiments the ATO film coatings are substantially transparent and in combination with a transparent substrate, such as glass, this enables the fabrication of an iron through which clothes being ironed are visible during ironing. This can provide benefits in that such an arrangement facilitates monitoring of the clothes being ironed such that creases to be ironed out are more easily seen by the user.

The use of an antimony tin oxide film also provides other advantages since, in embodiments, such films are scratch resistant, oxidation resistant, substantially chemically inert.

In preferred embodiments, the iron comprises a secondary layer of glass or ceramic laminated over said glass substrate with a gap there between. The secondary glass layer over the glass substrate provides a thermal and electrical insulation barrier from the glass substrate.

There is also provided a layer of transparent polymer disposed over said secondary layer of glass, such that a gap is formed between said transparent polymer and said secondary glass layer for thermally insulating the transparent polymer from the glass substrate.

This structure enables the clothes to remain visible to the user even during ironing, whilst insulating the user from the heat of the heated glass sole of the iron. The gap between the glass substrate and the secondary layer may be filled with an inert gas, for example krypton, for additional insulation.

However, in other embodiments the secondary glass or ceramic layer and/or the upper polymer layer may be opaque, in which case the user would not be able to see through those layers to the material underneath the sole plate in use.

In embodiments, the iron comprises a hub for attaching said sole plate to a handle, wherein the electrical connections from the power supply, and switches/controls to the heating element which are in the handle are routed through said hub. The outer casing of hub itself is electrically isolated from the internal electrical connections, so as to avoid risk of electric shock to the user. Preferably, the hub comprises one or more conduits for guiding steam to a surface of said sole plate.

In another embodiment, there is provided an iron having a vapour outlet positioned at a front of the iron, which emits water vapour or mist onto a region immediately in front of the tip of the sole plate, or through the sole plate face.

In preferred embodiments, the glass substrate of the iron is patterned with electrically and thermally conducting power rails in the form of metal tracks, for providing additional, localised, heating of said glass substrate. Preferably, the metal is silver.

In an embodiment of the iron, the power rails are formed of stripes along a substantial length of each of the longer edges of said glass substrate and one or more stripes along a substantial length of a central region of said glass substrate.

In an alternative embodiment, said power rails are formed of a rear portion disposed at a trailing end of said glass substrate, and a forward portion disposed at a leading end of said glass substrate, said rear portion covering substantially the width of the glass substrate and tapering towards the outer edges of the glass substrate, and said forward portion comprising one or more triangular portions and a bridging portion, said bridging portion covering a stripe across substantially the width of said glass substrate.

In a further alternative embodiment, said power rails are formed of edge portions along the long edges of said glass substrate, and wherein a forward portion of said edge portions located at a leading end of said glass substrate has a greater width than said edge portions along the remaining edge portion.

In yet a further embodiment, there may be provided a metal or metal oxide layer formed as an area over the sole plate between two edges of the sole plate. In this embodiment, there may be at least a pair of oppositely facing power rails, positioned one on each side of the sole plate, and extending between said pair of power rails, a continuous area of thin film metal oxide heating element. The thin film metal oxide heating element may extend across almost the full width of the sole plate, and may extend substantially along the whole length of the sole plate. Alternatively, a small number of separate areas of thin film, each independently controlled and each extending across a full width of the sole plate may be provided.

The shape of the sole plate need not be a conventional arched or bullet shaped sole plate area, but in other embodiments, elliptical, ovoid or other geometric shapes for the sole plate footprint may be formed. The shape of the sole plate footprint may influence whether the metal oxide heating element formed as a series of individual elements, or as a single film extending across the whole of the sole plate, or as a plurality of areas of film heating element extending across the sole plate.

In an embodiment of the iron, the electrical heating element is patterned to maintain a substantially constant heat profile across said glass substrate. This provides a substantially constant level of heat across the glass substrate, which leads to a substantially constant power rating.

Preferably, the pattern of said electrical heating element comprises a plurality of heating element tracks, and wherein each of said heating element track has substantially the same length.

Preferably, the glass substrate is patterned with first and second electrically conducting power rails for providing power to said heating elements, and wherein each of said heating elements is electrically connected between said first and second power rails. In this embodiment, the first power rail runs substantially along a central portion of the length of said glass sole plate and said second power rail runs substantially along one or more edges of said glass substrate. Preferably, the pattern of said heating elements comprises one or more turns in direction such that the heating element tracks follow a zig-zag or serpentine path between said first and second power rails.

In embodiments, the sole substrate bears a layer of semiconducting material, wherein said heating element is formed from said semiconducting material, and wherein said iron includes a temperature sensor comprising a portion of said layer of semiconducting material.

In some preferred embodiments the film coating comprises a semi conducting material and a switch for the heating element is fabricated within part of a layer of the same material (either within the heating element itself or as a separate device, for example patterned in a common layer of semiconducting material.

In some preferred embodiments, the iron comprises a steam generator for generating steam for applying to said sole plate, said steam generator comprising: a first tube; a second tube located within a bore of said first tube to define a first space between an inner wall of said first tube and an outer wall of said second tube, said second tube being coupled to a water input and having a plurality of conduits for communicating input water to said first space; a steam output coupled to said first space for expelling generated steam; a film coating of doped tin oxide on an outer wall of said first tube; and electronic connections to said film coating to enable electricity to be passed through said film coating to thereby heat water flowing through said first space to generate steam.

The term "tube" is not intended to be restricted to a circular cross-section. In embodiments, the tube cross-section may instead be elliptical, oval, rectangular, square, triangular, polygonal and the like.

In embodiments, the film coating comprises ATO (antimony tin oxide). Preferably, the first tube comprises a glass substrate. Alternatively, the first tube comprises a ceramic substrate.

In embodiments, the second tube comprises a first sub-tube located within the bore of a second sub-tube to define a second space between an outer wall of said first sub-tube and an inner wall of said second sub-tube, and wherein said first and second sub-tubes comprise a plurality of conduits for communicating input water to said first and second spaces. Preferably, the first and second sub-tubes are rotatable relative to one another about an axial axis of said tubes.

In embodiments, the film coating of the steam generator includes a temperature sensor comprising a portion of said film coating.

In some embodiments, the said steam generator further comprises: an electrical power input; and an electrical power control device electronically connected between said electrical power input and said film coating; wherein said electrical power control device is a semiconductor device; and wherein at least a portion of said semiconductor device comprises a portion of said film coating.

In embodiments, the steam generator comprises a non-return or one-way valve between the second tube and the water input to prevent water returning to the input. Preferably, the steam generator comprises a priming mechanism for providing an initial amount of water to the steam generator. Alternatively, the steam generator comprises a pump for providing water to the steam generator. Preferably the pump is a mechanical, electrical or heat pump.

The steam generator may form part of the iron, or may be separate from the iron. In embodiments where the steam generator is separate from the iron, the steam generator is connected to the iron by means of a connecting tube.

In embodiments the electrical heating element, in particular where it comprises a thin film, for example a layer of semiconducting material, may itself be used as a temperature sensor. In this case a signal maybe modulated onto the electrical power, typically DC or low-frequency AC, supplying the heating element, to enable this signal to be detected by demodulation. For example a higher frequency AC signal than a frequency of an AC current providing power for heating the heating element may be employed. Additionally or alternatively a region of the film maybe defined to be dedicated to temperature sensing and being provided with at least one separate electrode connection (optionally sharing one electrode connection with the heating element).

In an iron as described above an electrical power control device or switch maybe incorporated into a layer semiconducting material forming the heating element itself. For example by applying a gate electrode over an insulating layer on a portion of the semiconducting layer an FET (Field Effect Transistor) switch may be fabricated. Such a device may be fabricated in a dedicated, separately defined region of the semiconducting layer or may be incorporated into the heating element, for example extending along the length of an electrode connection to the heating element.

Thus in a further aspect an iron comprises: an electrical power input; an electrical heating element, and an electrical power control device electronically connected between said electrical power input and said electrical heating element; whereas said electrical heating element comprises a layer of semiconducting material on a substrate; wherein said electrical power control device is a semiconductor device; and wherein at least a portion of said semiconductor device comprises a portion of said layer of semiconducting material.

In embodiments the portion of the layer of semiconducting material comprising the electrical power control device is connected in series the material defining the electrical heating element, and in embodiments the semiconductor device and heating element may be part of the same, substantially continuous layer of semiconducting material (rather than needing to be defined in a separate, dedicated region of the semiconducting layer).

The device may comprise a diode, in particular a diode using a metal-semiconductor junction. Alternatively p-type and n-type doped regions of the layer maybe employed to fabricate a bipolar transistor. Alternatively, as previously described, an insulated gate FET (or junction FET) maybe fabricated. In general the power controlled semiconductive device comprises an FET, bipolar transistor, IGBT, thyristor, SCR rectifier, TRIAC, or other device. In embodiments the device and heating element and substrate may be substantially transparent.

Suitable materials include, but are not limited to, tin oxide, for example doped with antimony or fluorine, indium tin oxide, and silicon carbide.

In a second aspect there is provided a method of controlling electrical power to the electrical heating element of an iron comprising a layer of semiconducting material, the method comprising forming a semiconductor device in said semiconducting material comprising said heating element to control said electrical power.

Embodiments include a steam generator for generating steam said steam generator comprising:

a first tube;

a second tube located within said first tube to define a first space between an inner wall of said first tube and an outer wall of said second tube, said second tube being coupled to a water input and having a plurality of conduits for communicating input water to said first space;

a steam output coupled to said first space for venting generated steam;

a film coating of doped tin oxide on an outer wall of a said tube; and electrical connections to said film coating to enable electricity to be passed through said film coating to thereby heat water flowing through said first space to generate steam.

The steam generator can be located in the hand iron itself, or in a steam station which supplies steam to an iron. Where the steam station supplies steam to an iron having a glass or ceramic soleplate, the iron may have a further such steam generator used to reheat the steam at the iron.

Another embodiment comprises an iron comprising:

a glass or ceramic sole plate; and a semi-conductor heating element formed directly on said glass or ceramic sole plate;

wherein said heating element is formed in a substantially serpentine path.

According to a further embodiment, there is provided an iron comprising:

a substantially transparent or translucent glass or ceramic sole plate;

a substantially transparent semi-conductor film heating element formed on said glass or ceramic sole plate;

a secondary glass or ceramic layer positioned adjacent and spaced apart from said substantially transparent film heating element; and a further transparent cover layer positioned over and spaced apart from said secondary layer, such that a heat insulating gap is formed between said cover layer and said secondary layer for thermal insulating said cover layer from said sole plate.

According to yet a further embodiment, there is provided an iron comprising:

a glass or ceramic sole plate;

a plurality of heating elements formed on said glass or ceramic sole plate;

wherein said plurality of heating elements are arranged into a first region, in which a said heating element has a first power dissipation; and a second area in which a said heating element has a second power dissipation, wherein said first power dissipation is higher than said second power dissipation.

Said first, higher power dissipation area is positioned at or in a region of a tip of said sole plate.

The embodiments include an iron comprising:

a glass or ceramic sole plate;

a semi-conductor thin film heating element formed directly on said sole plate; and a semi-conductor thin film fuse element formed directly on said sole plate, and connected in series with said heating element, said fuse arranged to terminate a current flow when a current taken by said heating element exceeds a pre-determined threshold current.

In other embodiments, there may be provided a semiconductor thin film heating element with no semiconductor thin film fuse, but with a mechanical fuse in series with the thin film heating element. In yet other embodiments there may be provided a mechanical fuse in series with a semiconductor thin film fuse on the direct power to the heating element to provide additional safety.

The embodiments includes an iron comprising:

a glass or ceramic sole plate; and a semi-conductor thin film heating element formed on said glass or ceramic sole plate;

wherein said heating element comprises a plurality of tracks of semi-conductor thin film extending between a first power rail positioned on a first side of said sole plate and a second power rail position on a second side of said sole plate, wherein said plurality of tracks are arranged such as to provide a substantially uniform power dissipation across substantially a whole area of said sole plate.

Each of said plurality of heating elements may extend between said a first and second sides of said sole plate; and each said heating element extends from said first and second power rails, towards a tip of said sole plate.

Other aspects are as recited in the claims herein.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which:

FIG. 3*a* shows in view from underneath a second iron according to a second specific embodiment, having a transparent or semi-transparent glass or ceramic sole plate having a first heating element track layout;

FIG. 3*b* illustrates schematically in view from underneath a third iron having a transparent or semi-transparent glass or ceramic sole plate having a second heating element track layout;

FIG. 3*c* illustrates schematically in view from underneath a fourth iron having a transparent or semi-transparent glass or ceramic sole plate having a third heating element track layout;

DETAILED DESCRIPTION

There will now be described by way of example a specific mode contemplated by the inventors. In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description.

In specific embodiments disclosed herein, there is provided an iron having a glass or ceramic sole plate, which is heated directly by a thin film semi-conductor material, for example an antimony tin oxide coating, or an equivalent semi-conductor coating, for example doped indium tin oxide (ITO) or doped fluorine tin oxide (FTO).

In this specification, where the term antimony tin oxide is used, this encompasses materials including antimony oxide and tin oxide, and including materials with the chemical formula $Sb_3O_4$*$SnO_2$, as well as materials with the formula $Sb_2O_3$*$SnO_2$, including such compounds which are doped with donor or acceptor materials so as to affect the resistivity or conductivity of the antimony tin oxide material. The material may be formed on a glass or ceramic substrate by sputtering, evaporation, chemical vapor deposition (CVD), or by other known processes for forming or depositing a semi-conductor layer on to a glass or ceramic substrate.

In this specification, where the term "heating element" is used, this generally describes a doped metal oxide film through which electricity is passed to generate heat. The heating elements may be divided into elongate straight, curved or meandering tracks, or may be formed as areas of different geometric shapes.

Where the term "power rail" is used, this generally refers to a metal strip, track, film or coating used to supply power to one or more heating elements.

The Iron makes use of clear thin film resistive coating (e.g. ATO) on a glass substrate as the heating element to provide the mechanism for heating a sole plate to facilitate crease removal from fabrics.

Iron with Central Hub

Figure 1:
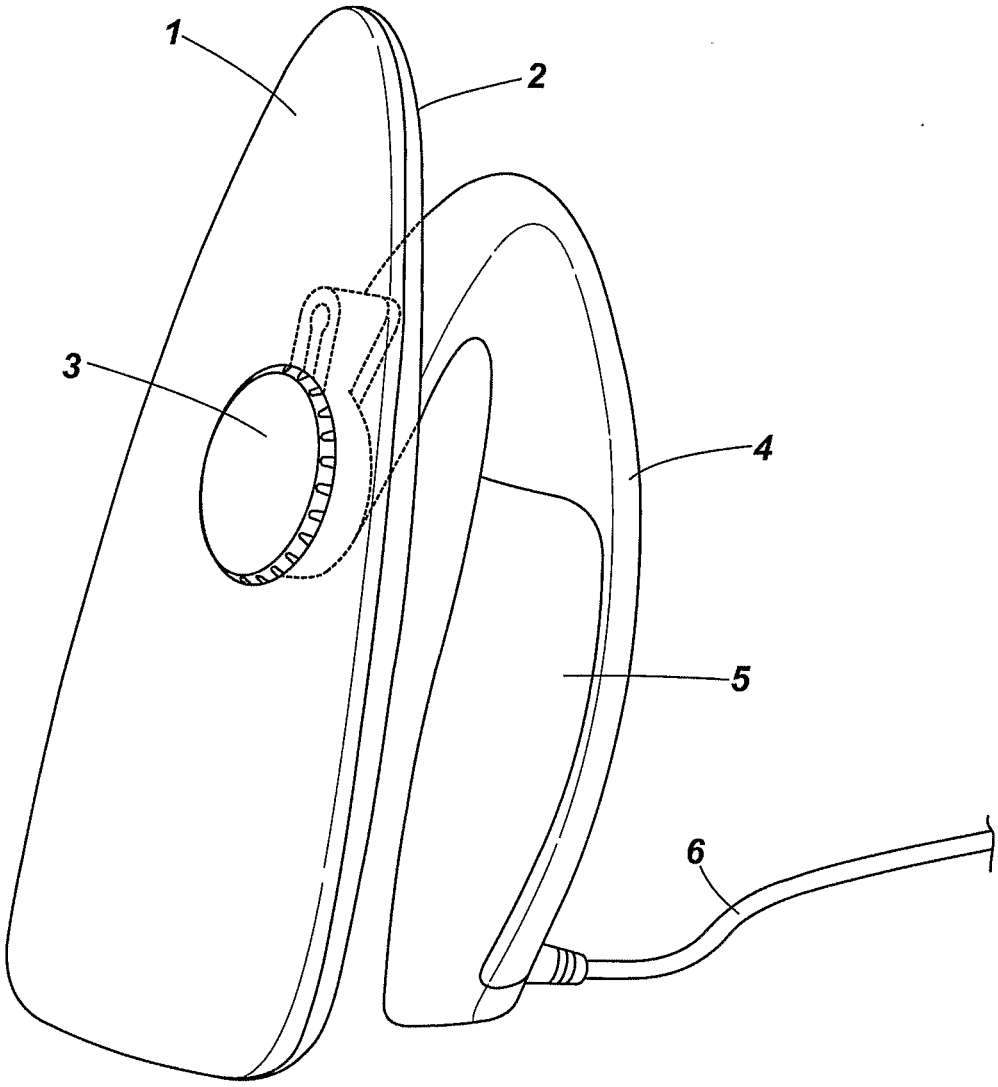
FIG. 1 shows an embodiment iron according to a first specific embodiment of the invention.
Figure 2:
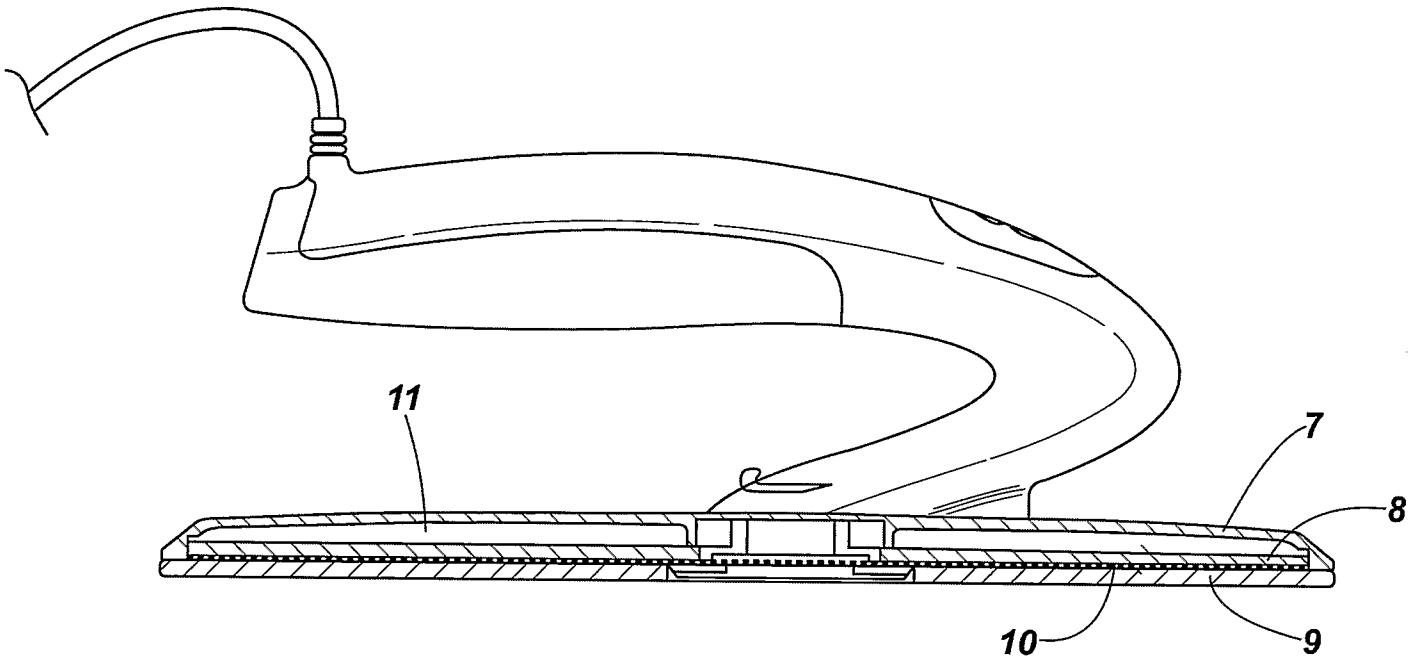
FIG. 2 shows a side view of the iron of FIG. 1.

Referring to FIGS. 1 and 2 herein, an iron comprises a glass sole plate (1); an upper transparent portion (2); a handle (4) attached to the upper transparent handle; and a hub (3) connecting the sole plate to the handle.

Steam is delivered to the garment being ironed through the hub (3), which also forms the fixing point for the glass panels and electrical contact to the film coating on the glass sole.

The sole plate assembly is thermally and electrically insulated from the handle assembly (4) by a combination of a secondary glass sheet (8) laminated over the ATO coating (dotted line 10), an air gap (potential to fill with inert gas, such as krypton, for extra insulation) and a transparent moulded polymer (7).

In the iron of FIGS. 1 and 2, a steam generator as described with reference to FIG. 5 herein may be incorporated within the handle of the iron, as a tubular heating element, so that water may flow from a base reservoir unit through a feed tube connecting the base unit to the hand iron, and passes through the tubular heating element within the handle so as to be ejected as steam or heated spray at the sole plate. Water is heated continuously, as it flows through the inline tubular heating element contained within the handle.

In FIG. 2, the laminated construction of the first iron is shown in cross sectional view. The layers include a glass or ceramic plate (9) which forms a main structural body of the sole plate; formed directly on top of the glass sole plate, a thin film heating element coating for example an ATO coating; on top of the ATO coating, secondary transparent glass or ceramic sheet (8), which is in direct contact with and bonded to the sole plate (9) and the ATO coating (10); above the sole plate/secondary plate laminate (8, 9, 10) is provided an upper casing (7) which may be ceramic, or of a moulded transparent polymer or plastics material. Between the transparent casing (7) and the secondary sheet (8) is a void cavity (11), the purpose of which is to provide thermal insulation from the secondary glass sheet (8) which may heat up to a temperature similar to that of the glass sole plate (9). The upper transparent casing (7) prevents a user from burning themselves on the underlying sole plate and secondary glass or ceramic plate (8) and provides an acceptable touch temperature, whilst its transparent properties allows the user to see through the casing, secondary glass sheet and sole plate to see the fabric underneath the sole plate as it is being ironed and pressed.

Key benefits have been identified when using thin film technology as heating mechanism, these include:

- Visibility through to the fabric to be ironed (avoiding ironing in creases and for navigation around garment fixings (zips, buttons etc)).
- Improved manoeuvrability due to the surface quality of the glass (minimal drag) and lightweight assembly.

Zonal Heating

Figure 3C:
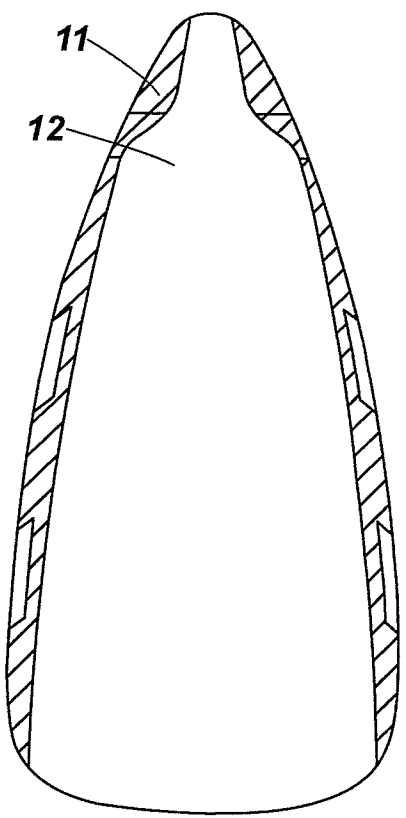
FIGS. 3*a* to 3*c* show embodiment irons with different patterns of power rail on the sole plate.
Figure 3B:
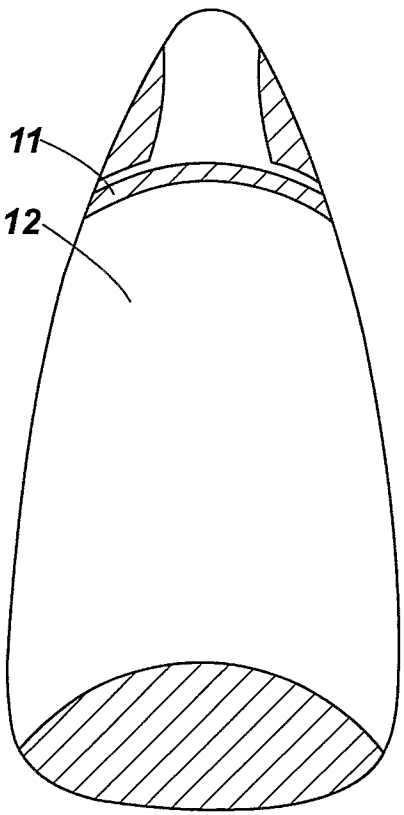
Figure 3A:
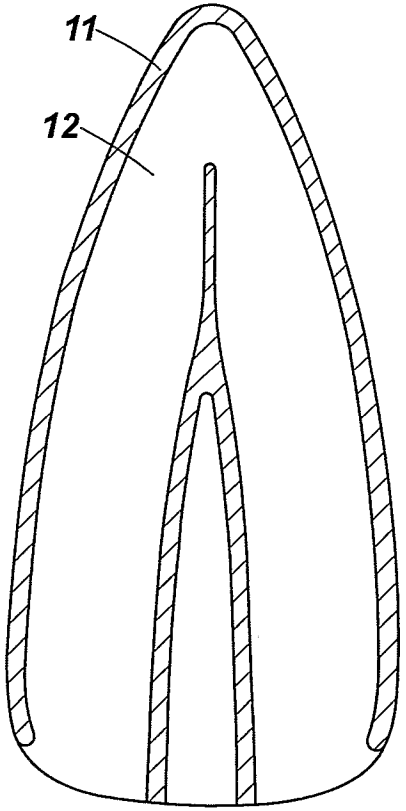

Referring to FIGS. 3*a* to 3*c* herein, the ATO coating (12) and printed silver tracking (11) can be configured to optimise the base plate efficiency and bring intelligence in zonal heating to the soleplate for different ironing tasks.

The structure of FIG. 3*a*, this pattern will create an even horseshoe band of heat on the soleplate.

The structure of FIG. 3*b* will create a consistent even heat to the main plate and allow the front tip to be tweaked for 'intense' heat if required to iron out stubborn creases.

The structure of FIG. 3*c* will create a graduated heat profile to the main plate (hotter towards front) and allow the front tip to be tweaked for 'intense' heat if required.

Key benefits have been identified when using thin film technology as heating mechanism, these include energy savings due to 'heat zoning', when the electrodes can be designed to be switchable and allow shut off or pulsing of particular areas of the heating surface. This helps with cost savings in the Bills of Materials (BOM) and manufacturing process.

Figure 3D:
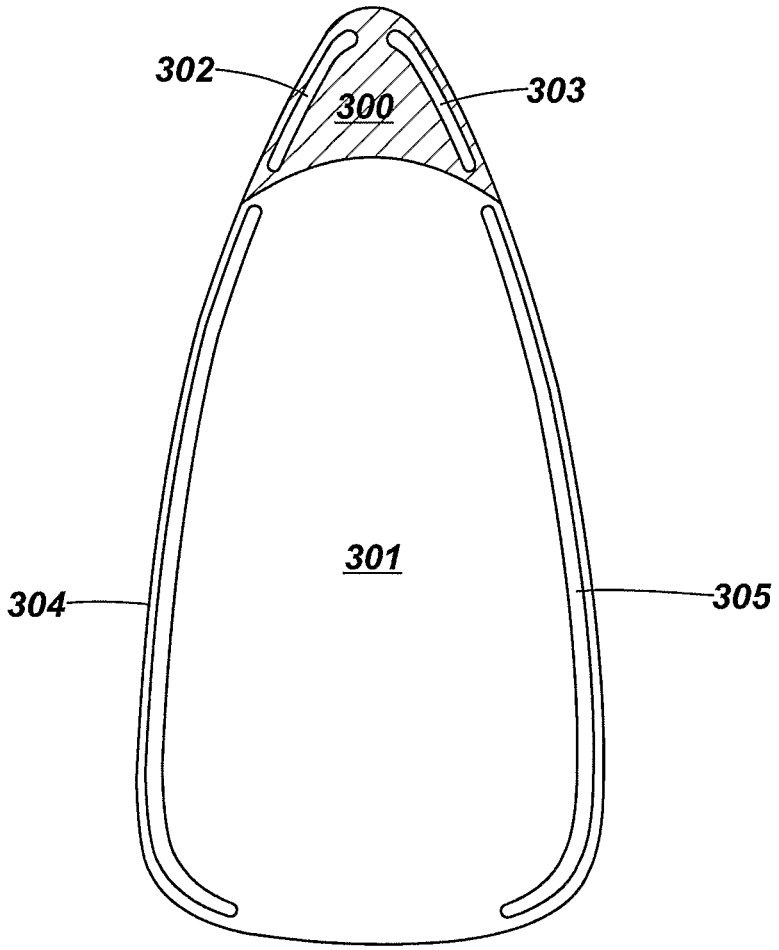
FIG. 3*d* illustrates schematically in view from underneath fifth iron having a transparent or semi-transparent glass or ceramic sole plate having a fourth heating element track layout, having a relatively higher power output at the tip of the sole plate compared to the main body of the sole plate.

Referring to FIG. 3*d* herein, there is illustrated schematically a fifth iron sole plate having a zoning of heating elements so as to provide a relatively higher power density heating element (300) at a tip of the iron compared to the relatively lower power density heating element (301) in the main body of the sole plate. Higher power density may be required at the tip of the iron particularly where the iron is a steam iron or has a spray which emits water from the front of the iron. Where the iron moves in a forward direction and encounters wet or damp cloth, extra energy is required to evaporate moisture or dampness in the cloth at the tip of the iron, compared to in the main body of the iron. When the sole plate is moving in a forward direction, the fabric encountered by the main mid region of the sole plate may be relatively dryer, the moisture having been predominantly evaporated as the tip of the iron moves over the fabric. If the sole plate had a uniform power density across its area, the tip of the iron would become cooler than the main body of the iron, since it has more "work" to do, i.e. must dissipate more energy, because it is the first part of the sole plate which encounters moist or damp fabric. This can be compensated for by providing two different power density zones on the iron with a higher power density heating zone at the tip of the iron compared to the remainder of the sole plate. Since the glass sole plate does not have good thermal latency, the tip may need to have a higher power density heating element to give a faster response time to re-heat after ironing damp fabric.

In FIG. 3*d*, each heating zone may be provided with its own temperature control in the form of its own corresponding respective thermister or other temperature control circuit, so that each of the two heated regions may have their temperatures maintained substantially independently from each other, subject to thermal transmission through the glass or ceramic material of the sole plate between adjacent differently heated regions.

The sole plate is not restricted to having two separately temperature controlled and separate temperature heated regions, but rather a plurality of more than two such reasons may be provided on the same sole plate, each having its own corresponding respective heating element and temperature control circuitry. Each heated region may be provided with its own metallic power rails, for example (302, 303) for the tip region (300), or live and neutral power rails (304, 305) for the central region (301) as shown in FIG. 3*d* herein.

Figure 4:
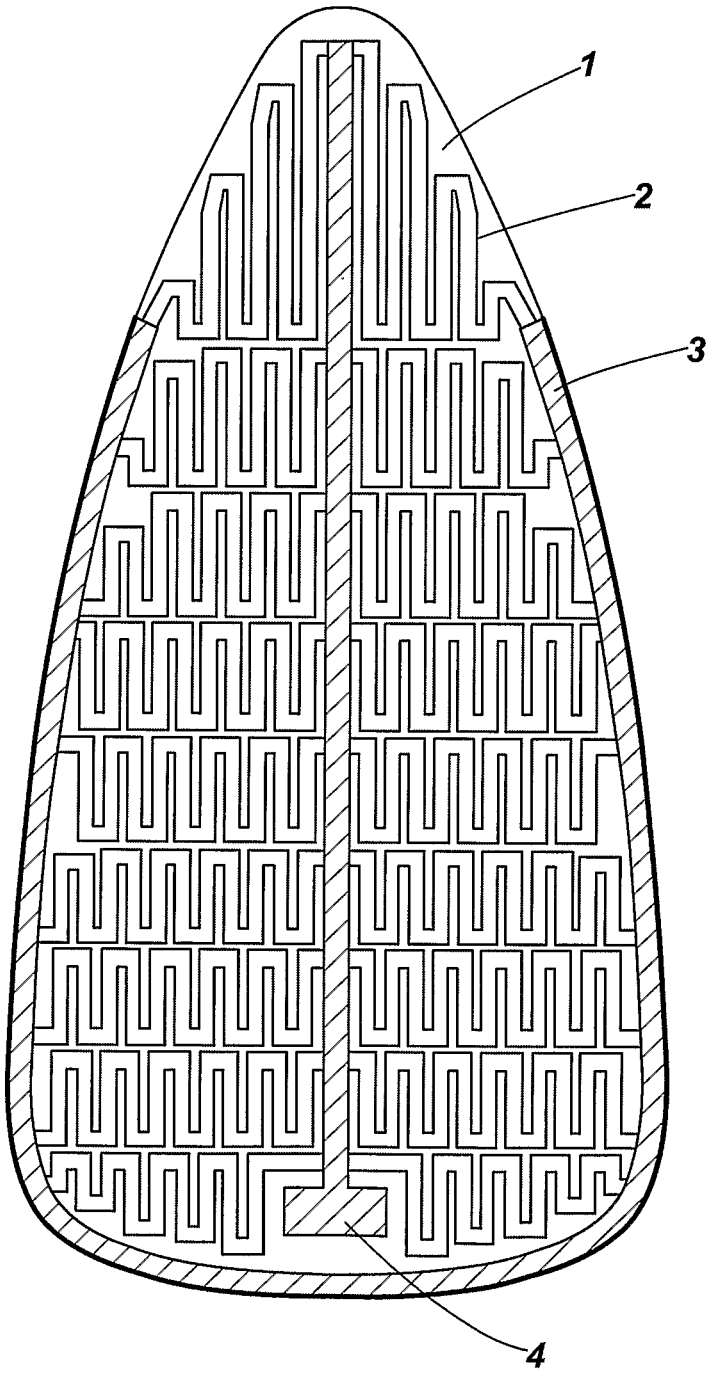
FIG. 4 shows a sixth embodiment iron with an alternative pattern of heating element and power rail on the sole plate.

Referring to FIG. 4 herein, an alternative scheme is shown. The ATO coating (or other doped oxide coating) (2) and/or conducting power rails (3, 4) can be configured to maintain a substantially constant power rating (and therefore heat profile) on an irregularly shaped heating or sole plate of the iron.

As shown in FIG. 4, the ATO coating is patterned into a plurality of heating elements (2) on the glass sole plate (1). The heating elements span between, and are electrically connected to electrically conducting power rails (3, 4). The conducting power rails (3, 4) provide power to the plurality of heating elements (2).

In order to achieve a substantially constant power rating (and therefore heat profile), each of the heating elements (2) are designed to be substantially the same length. In this embodiment, the heating elements are shown to turn direction in a zig-zag or serpentine manner between the power rails (3, 4), with the distance between each turn varying dependent on the position of the individual heating element track on the glass sole plate such that the same track length of heating element is achieved across the whole of the glass sole plate.

Whilst a zig-zag pattern is shown, it would be apparent that other shapes could be considered, with the heating element tracks (2) running in a length-ways configuration, arcs or other geometric shapes. It is also envisaged that the patterned heating element track (2) of FIG. 4 could be used in conjunction with the patterned metallic tracks for localised heating described above and with reference to FIG. 3 for controlled heating.

Steam Generator

Figure 5:
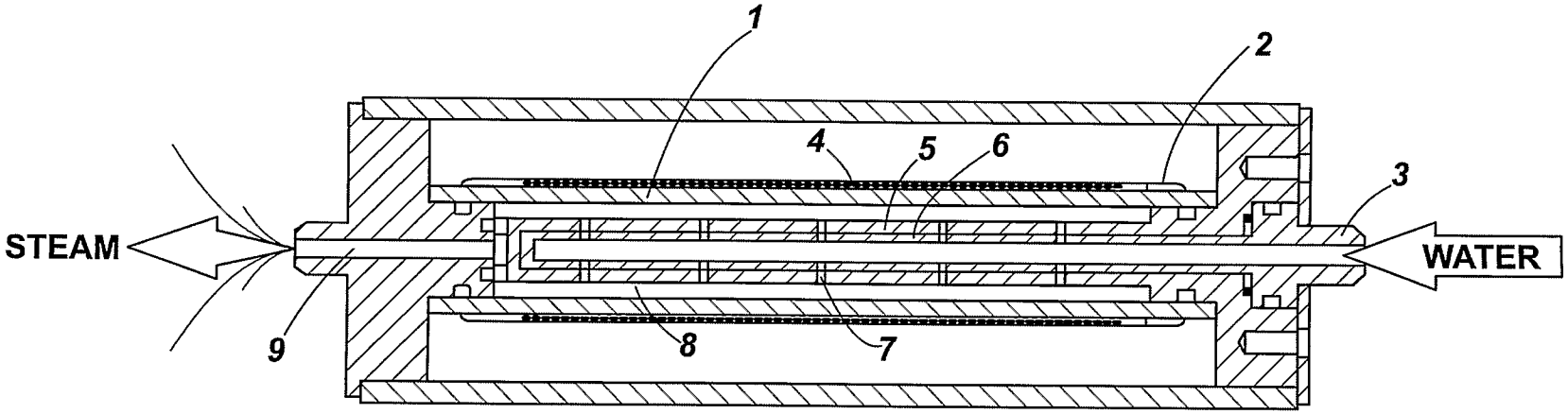
FIG. 5 shows a cross section through a steam generator according to a seventh specific embodiment disclosed herein.

Referring to FIG. 5 herein, we will now describe a steam generator which makes use of a high power density clear thin film resistive coating (ATO) on a glass/ceramic substrate as the heating element to provide compact steam generation. The steam generator may be used in conjunction with the iron described above, either integral to the iron, or as a stand-alone unit connected to the hub of the iron.

An internal sub assembly of perforated tubes (5) (6) can be rotated relative to each other to give a variable fine spray/jet of water through aligned holes (7) directly on the internal surface of an outer (ATO) coated (4) tube heater (1). Steam is created in the internal chamber (8) and forced out under is own pressure through the nozzle (9). Electrical connection to the resistive coating is made via 2 printed silver contact strips at distal ends of the tube heater (2).

If necessary, a non-return or one way valve can be located at (3) to prevent back pressure into the water reservoir. Under such a scheme it is possible for the mechanism to self pump with an initial priming mechanism.

Alternatively the water would be pumped into the steam generator using an electrical, manual or heat pump.

Key benefits include the ability to create the steam at source (within the iron build) or within a steam generating base/stand and therefore assist with current issues found in current steam generator products i.e.:

- Reduced heat up time of initial steam in cold tube set from generator to iron (at source version)
- Reduced limescale build up within tube set, since limescale does not adhere well to either ceramic or glass (at source version)
- Minimise the size and cumbersome nature of current generators allowing for more water storage and possible reconfiguration/appeal of stand unit (Upright docking station, see through water container, etc)

Another configuration is that this system can be just used as a secondary heat source in the iron component to keep the steam being delivered at high temperature on exit.

The coating itself can be used to sense the temperature of the element and/or the amount of water present in the heater as well as switching the heating zones or sections of the element, which we shall now describe.

The steam generator may be provided in a self contained steam iron. In other embodiments, the steam generator may be located in a steam station separate from the hand iron, and the steam is fed to the hand iron via a tube.

In a conventional steam iron being supplied with steam from steam station, the steam passes into a chamber above the soleplate, and heat stored in the metal soleplate serves to reheat any condensate in the steam received from the steam station. However, if the iron is a glass or ceramic soleplate iron, there is no reheat chamber above the soleplate, and so a further heater or steam generator may be necessary in the iron itself as a reheat to remove any condensate in the steam supplied from the base station. Therefore, in a separate embodiment there is provided a steam station and station comprising a base station and a steam iron having a glass soleplate, where the base station comprises a steam generator as described in FIG. 5, and the steam iron also has a steam generator as described in FIG. 5.

Thermal Sensor

Typical thin film coatings are intrinsic semiconductors. For example, SiC and tin oxide are both semiconductors with large band gaps (typically ~3.2 eV). By doping the semiconductor can be made to be n-type or p-type. Typically, impurities make the thin film an n-type semiconductor. For example, ATO is an n-type semiconductor. However p-type semiconductors can also be produced.

Typical thin film materials hence have a reversible resistance-temperature characteristic and thus the heating element itself can be used as a thermal sensor to measure the temperature of the heating element or substrate. Alternatively, a separate area of thin film which does not constitute part of the heating element, but placed on the same substrate close to the element can be used to measure the temperature using a separate low voltage/low current circuit. The area can be manufactured using a masking process when the main heating element is being created.

It is preferred to detect the resistance change using a low voltage/low current so that the sensitivity is improved and the semiconductor is not saturated, hence a separate area for thermal detection is preferred rather than using the bulk element itself. Should the bulk element need to be used, then a high frequency signal multiplexed on to the DC or low frequency AC bias can be used to detect variation in resistance, without the requirement to measure high voltages or currents.

The thermal sensor can also be used to detect the temperature of the water.

Switching Mechanism

In embodiments the heating elements are required to be switched on and off. This may achieved using a manual switch, a relay or a solid state switching device, generally separated from the heating element itself. However this can add extra cost to the overall system.

Hence, it is desired to create a system by which the heating element switch is included within the heating element. Given that the thin film technology is a semiconductor, it is possible to create at the same time as the heating element different types of semiconductor switch or rectifier. In particular, one can produce a FET device by overlaying a thin insulator, such as mica or silicon dioxide on top so an area of the thin film element (typically where the current enters or leaves the element). On top of the insulator a metallisation layer is created to which a voltage can be applied to switch the element. Further devices are possible: for example, at the metal-thin film junction a Schottky diode is created, further using n-type and p-type variants of silicon carbide or tin oxide it is possible to create a rectifying diode or bipolar transistor. Because the material can withstand high temperatures, there is no need for a heat sink and any heat losses are directly used in the heater, thus increasing efficiency as well as reducing cost. Many of these devices can be transparent and hence can be used within the iron to switch the elements to provide different heating levels and control.

In embodiments the element may be switched by TRIAC switching, with differential choke filtering (for example, a differential mode filter of 18 mH) for EMC capability.

Uniform Heat Distribution

Whilst the serpentine heating element track pattern as shown in FIG. 4 herein is aimed at achieving a substantially constant power rating and therefore heat distribution across the surface of the sole plate, the pattern shown in FIG. 4 is subjected to draw backs.

Firstly, the configuration of FIG. 4 requires a central power rail (4) down a centre line of the sole plate, acting as a live or neutral power supply line, and first and second peripheral power supply lines, one on each side of the sole plate. The central power supply track (4) may interfere with an even heat distribution down the centre line of the sole plate.

Secondly, the central power supply rail is visually unattractive to the user, being relatively wider than the serpentine heating elements (2).

Thirdly, the zig-zag or serpentine heating elements extending between the central power rail track (4) and the lateral power rail track (3) are shaped such as to have sharp corners and relatively sharp angles. Sharp corners give rise to high electric field values at the apexes of the corners, which can cause hot spots, and reduce reliability.

An alternative arrangement would be to have one power rail (for example live) on one side of the sole plate, and another power rail (for example neutral) extending along the other opposite side of the sole plate, with a resistive ATO doped semi-conductor film extending across the centre of the sole plate between the two power rails.

Figure 6:
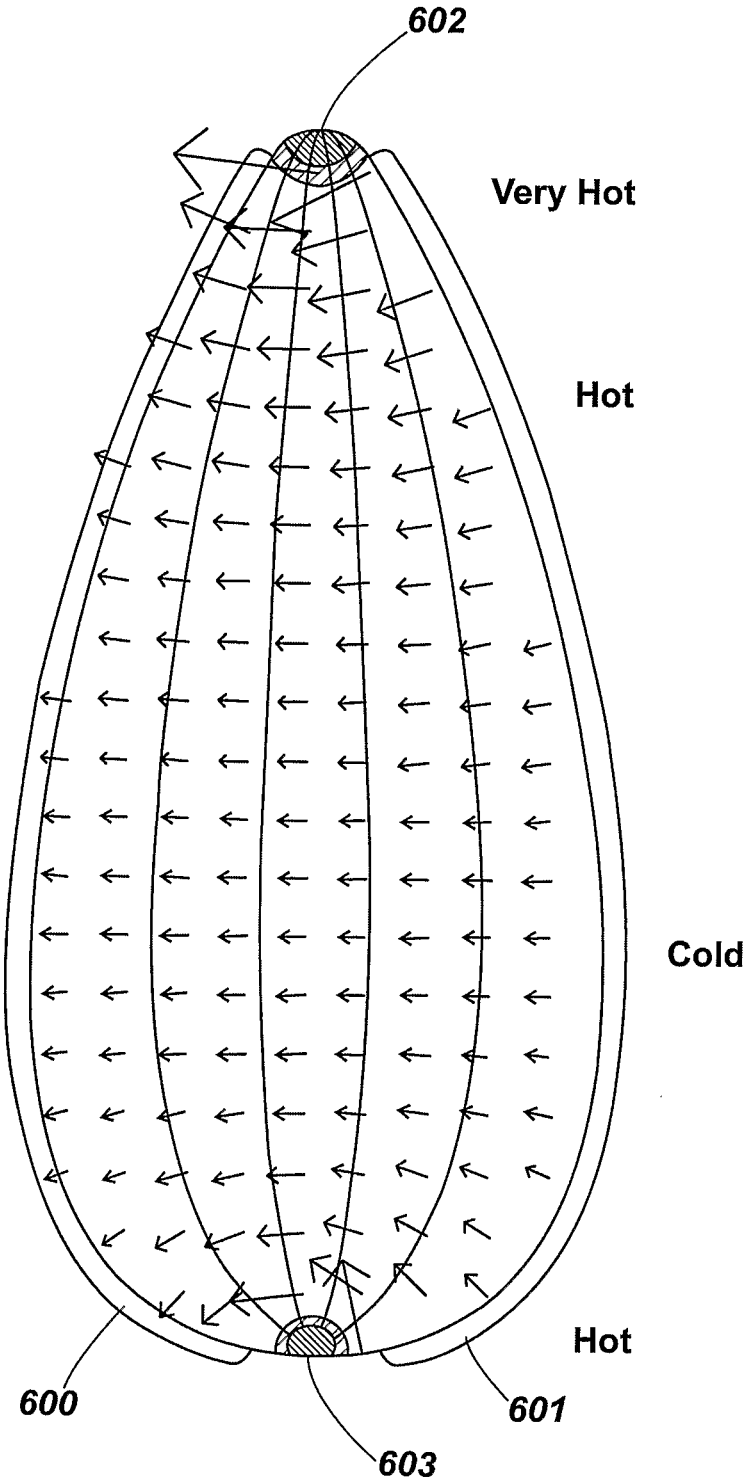
FIG. 6 shows a distribution of current across a sole plate having a uniformly coated thin film heating element, showing build up of hot spots.

Referring to FIG. 6 herein, there is illustrated schematically a sole plate comprising a constant thickness doped semi-conductor resistive film capable of acting as a heating element between first and second power rail tracks (600, 601) respectively one on each side of the sole plate. The doped semi-conductor film is formed on a glass or ceramic sole plate. The arrows shown in FIG. 6 represent current direction between the two power rails (600, 601). The power rails (600, 601) are formed of a material which is more conductive than the doped antimony tin oxide resistive film. For example the first and second power rails (600, 601) could be formed from antimony tin oxide which is doped to act as an efficient electrical conductor.

However, using a constant thickness electrically resistive film which generates heat between the two power rails leads to a non-uniform heat distribution across the sole plate, due to the irregular non-rectangular shape of the sole plate. In particular, as the width of the sole plate reduces at the tip (602) and the rear of the sole plate (603), the current density in the ATO film increases relative to its density in the centre of the sole plate, leading to hot spots at the tip and rear of the sole plate relative to the centre of the sole plate. Power density is proportional to the square of the current density, and so the power density is even less uniform than the current density. The tip of the sole plate and the rear of the sole plate receive much more power than the centre of the sole plate and will get much hotter than the centre of the sole plate.

Consequently, a uniform resistive thin film between two electrodes either side of the sole plate would result in an iron having a relatively hot tip and rear, and with the centre of the sole plate being relatively cool.

Figure 7:
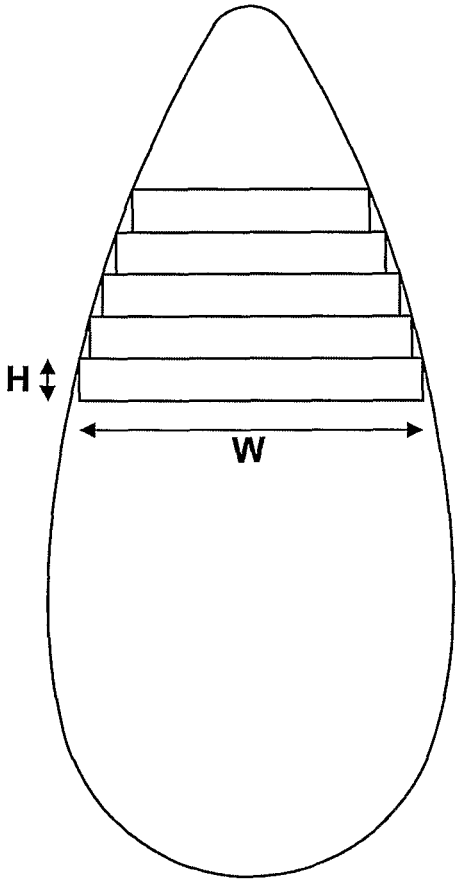
FIG. 7 illustrates schematically one possible approach to reducing the hot spots on the iron sole plate shown in FIG. 6 herein.

Referring to FIG. 7 herein, one possible solution to the problem of hot spots on the sole plate would be to vary the sheet resistance of the ATO film. For example as shown in FIG. 7 herein, the sole plate of the iron could be divided into a plurality of substantially rectangular ATO film sections each having a width W across the width of the sole plate, and each having a height H, being the height of the strip extending between the tip and the rear of the sole plate. Each of the rectangles of ATO thin film has a different sheet resistance. The power density within each strip of ATO film varies according to the relationship:

$$\frac{P}{A} = \frac{V^2}{\sigma_s}\frac{1}{W^2}$$

However, this approach has the drawback that, for a constant 5.5 W/cm$^2$, the sheet resistance needs to vary enormously in order to give constant power density, and therefore constant heat distribution within each strip. For example, the resistance would need to be 100 Ohms/per square (Ω/sq), for a trip of width 10 cm. For a strip of width 3 cm, the sheet resistance needs to be 1000 Ohms/per square (Ω/sq) and for a strip of film 1 cm wide, the sheet resistance would need to be 10,000 Ohms/per square (Ω/sq) in order to achieve a constant power density.

Figure 8:
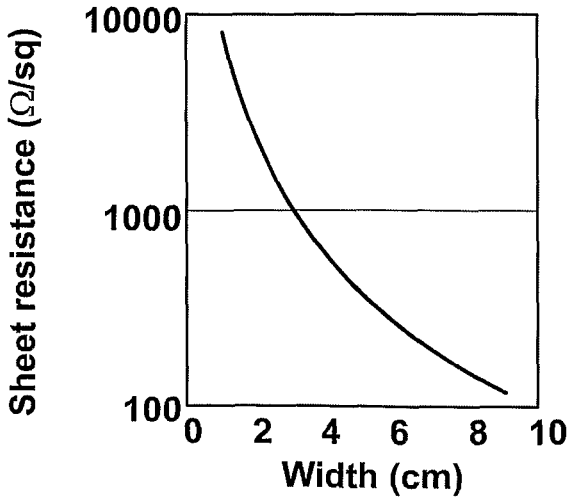
FIG. 8 illustrates schematically a graph of sheet resistance against width for the sole plate as shown in FIG. 7 herein.

Referring to FIG. 8 herein, there is illustrated schematically a graph of resistive element width in centre metres, against the required sheet resistance in ohms per square to achieve constant power density.

The sheet resistance cannot be varied widely enough to make this approach practicable. This approach is unlikely to work because the sheet resistance of the ATO film needs to vary too much (by a factor of 100) in order to give a constant power density across a sole plate area having curved sides.

Another approach to even out the power density may be to vary the height of the rectangular strips of thin film heating elements between the front and the rear of the sole plate.

Figure 9:
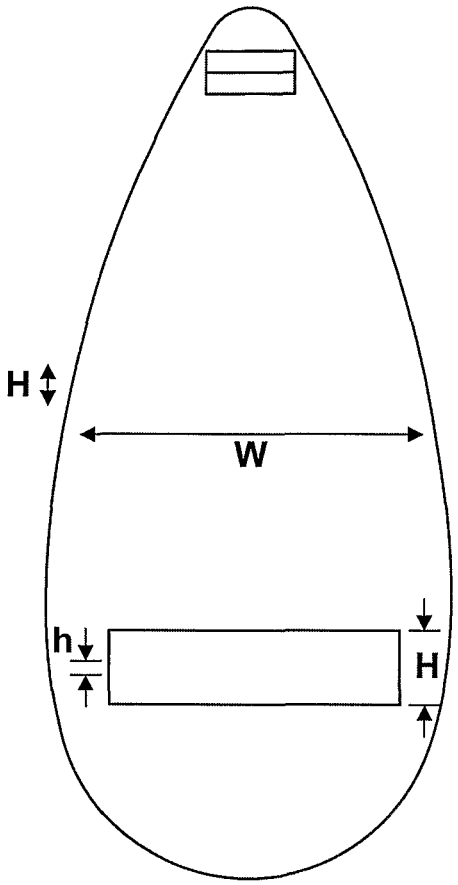
FIG. 9 illustrates schematically a second approach to reducing the build up of hot spots on the iron sole plate of FIG. 6 herein.

Referring to FIG. 9 herein, there is illustrated schematically in plan view from above, a glass or ceramic sole plate having a plurality of ATO heating elements each extending across the width of the sole plate, each heating element having a width W and a height h, where each heating element is contained within an area of width W and height H. Each heating element does not necessarily fill the whole of the rectangular area with dimension W×H.

In this approach, the power density of each heating element is determined by the equation $$\frac{P}{A} = \frac{V^2}{\sigma_s}\frac{1}{W^2}\frac{h}{H}$$

In this case, for a constant power density of 5.5 W/cm$^2$, the heated proportion of each area (h/H) needs to vary widely. For example, for a width W of 10 cm, the height h of the ATO strip needs to be 100% of the height of the area H. For a 3 cm wide strip, the height h of the heating element needs to be 10% of the height of the rectangular area, and for a heating element 1 cm wide, the height h of the heating element needs to be 1% of the height H of the rectangular area.

Figure 10:
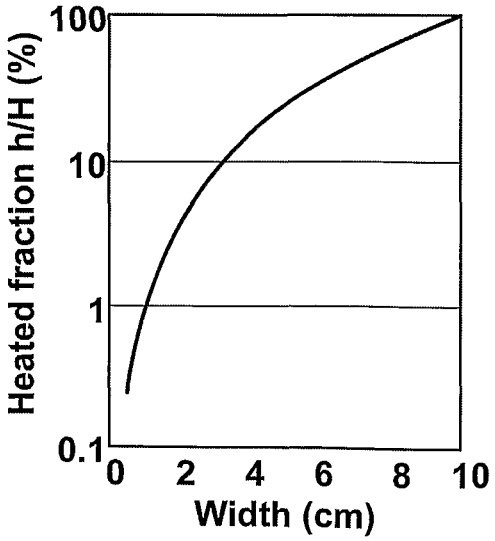
FIG. 10 illustrates schematically a plot of heated area fraction against width for the heating elements as shown in FIG. 9 herein.

Referring to FIG. 10 herein, there is illustrated a graph of track width in cm against the proportion of the area heated, for heating element track widths in the range approximately 0.5 cm to 10 cm.

Even if the resistance of the thin film coating is varied as well, the dimensions of the heating element still vary too widely to make this approach a practical solution. At the front of the iron, the height of the strips would be impractically small, for example 0.1 mm high strips, spaced 1 cm apart.

Figure 11:
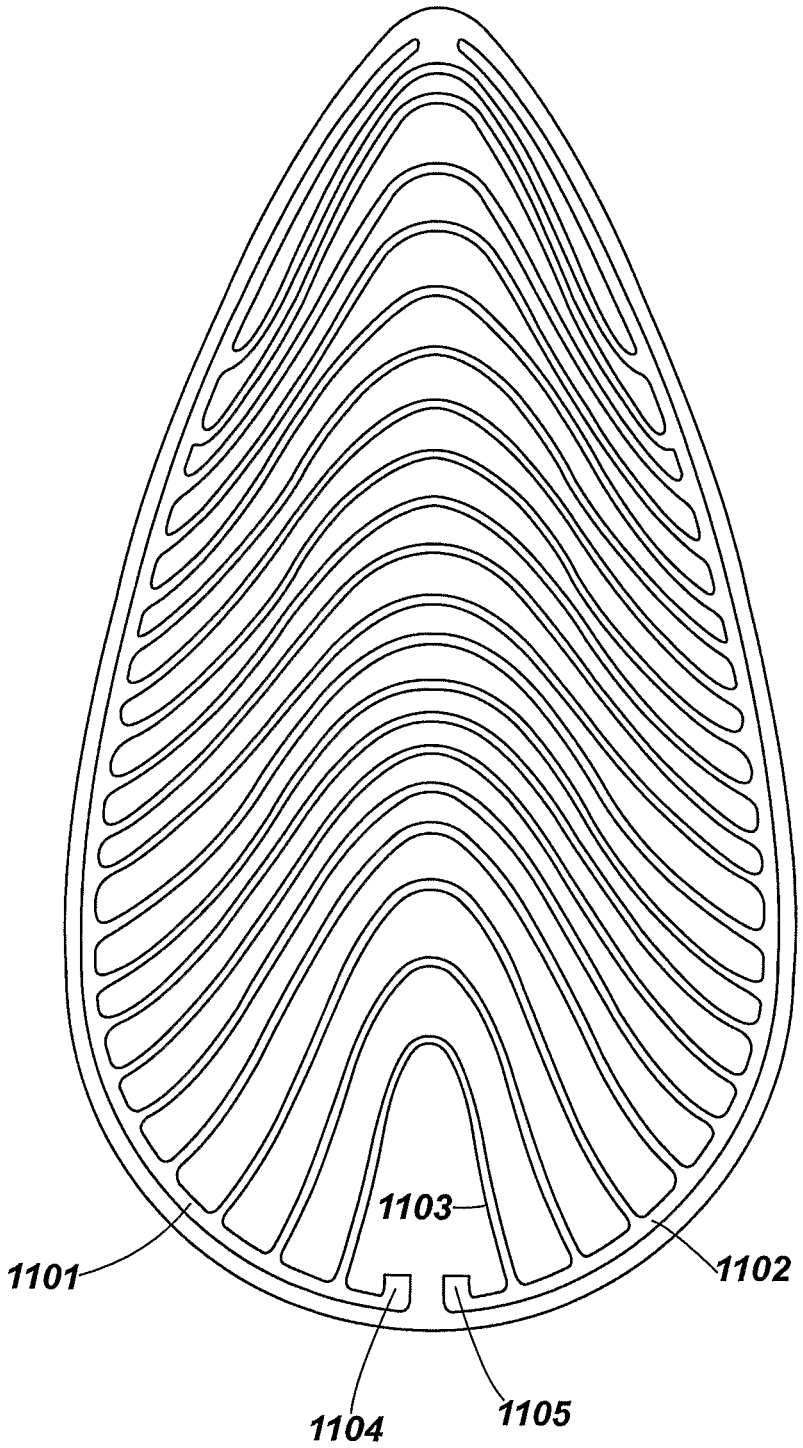
FIG. 11 illustrates schematically a seventh iron according to an eighth specific embodiment, having a sole plate patterned with thin film heating elements to achieve a substantially uniform power density.

Referring to FIG. 11 herein, there is illustrated schematically in view from underneath a fifth iron having a transparent or semi-transparent glass or ceramic sole plate, having a fourth heating element track layout. The sole plate has formed on it a first ATO power rail track (1101) extending around one side of the sole plate, and a second ATO power rail track (1102) extending around a second, opposite side of the sole plate. Between the two power rails are positioned a plurality of thin film semi-conductor resistive heating elements such as antimony tin oxide, fluorine tin oxide or indium tin oxide film resistors. Each heating element extends between the first power rail and the second power rail in a path which veers towards the tip of the front plate, extending from a power rail relatively at the rear of the sole plate, towards a peak position towards the tip of the sole plate, and then returning back to join the other opposite power rail towards the rear of the sole plate.

In view from underneath, each heating element follows a substantially part sinusoidal path between the first and second power rails, wherein an element towards the rear most of the sole plate has a relatively highest sine wave spatial frequency, and individual elements towards the centre of the sole plate, at the position where the sole plate is widest have a relatively lowest spatial period or frequency. From a position at the widest point of the sole plate towards the tip, each of the elements has a successively reduced spatial period towards the tip, the period frequency of the substantially sinusoidally shaped elements being determined by the distance between the ends of the element where they meet the corresponding respective first and second power rails.

The arrangement of elements is designed such that for a constant thickness film and constant width of the element, the shape of the elements, the spacing's between the elements and the positions of the elements relative to each other give rise to a substantially uniform power density and substantially uniform power dissipation across the sole plate, avoiding localised hot spots. The heating elements have the appearance of a set of ribs running across the area of the sole plate.

At the rear of the sole plate, are provided a pair of contact regions (1104, 1105), for contact of the respective first and second power rails to live and neutral power supplies.

Thermal Fuse

Figure 12:
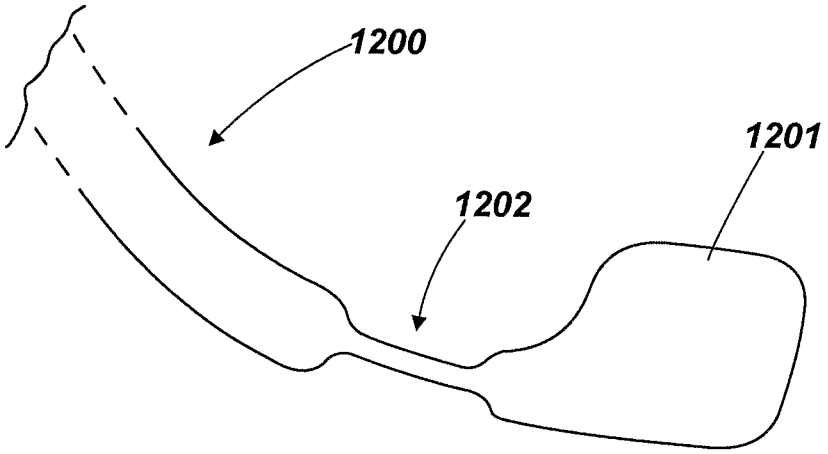
FIG. 12 illustrates schematically a one time thermal fuse formed from a thin film coating according to a ninth specific embodiment.

Referring to FIG. 12 herein, there is illustrated schematically in close up view, a portion of a power rail (1200) of the sole plate of FIG. 12, positioned between a contact pad (1201) for connecting to a live electrical power supply, and a plurality of heating elements connected further along the power rail. The power rail section contains a narrowed portion (1202) of relatively reduced track width, the width of the power rail being selected so as to overheat and evaporate or otherwise burn out, at a pre-determined current density and therefore to self destruct as a one time thermal fuse in the event of overheating of the sole plate.

If, for example there is a short circuit between the first and second power rails, increased current will flow through the reduced width section of the power rail, thereby increasing current density and causing the reduced section of power rail to "blow" thereby cutting the power rail. The narrowed fuse section may be doped slightly differently to the rest of the power rail, for example with a slightly higher resistance, in order to give it different conductivity properties to the power rail, in addition to, or instead of having a reduced width.

In other embodiments, instead of or as well as having a reduced width, the thickness of the film may be varied, to a reduced thickness compared to other parts of the power rail, so that in any event, the fuse section of the power rail is electrically and physically the weakest part of the power rail, and is designed to self destruct as a pre-determined current flows through the power rail. Once the fuse section is blown, it is not repairable and the sole plate or iron requires replacement. The fuse section of the thin film power rail is designed to be relatively weaker, having relatively reduced dimensions compared to the rest of the power rail, and/or having relatively lower conductivity compared to the rest of the power rail, so that it acts as the electrically weakest part of the power rail.

The embodiments may have a further fuse between the power cable and the controls as well as a fuse between the controls and the heating element.

In addition, there may be provided a further mechanical fuse on the heating element side of the controls and switches as well as or instead of the semiconductor thin film fuse. Thermal fuses may be provided on each side of the controls.

Iron with Rear Connected Handle and Separate Reservoir

Figure 13:
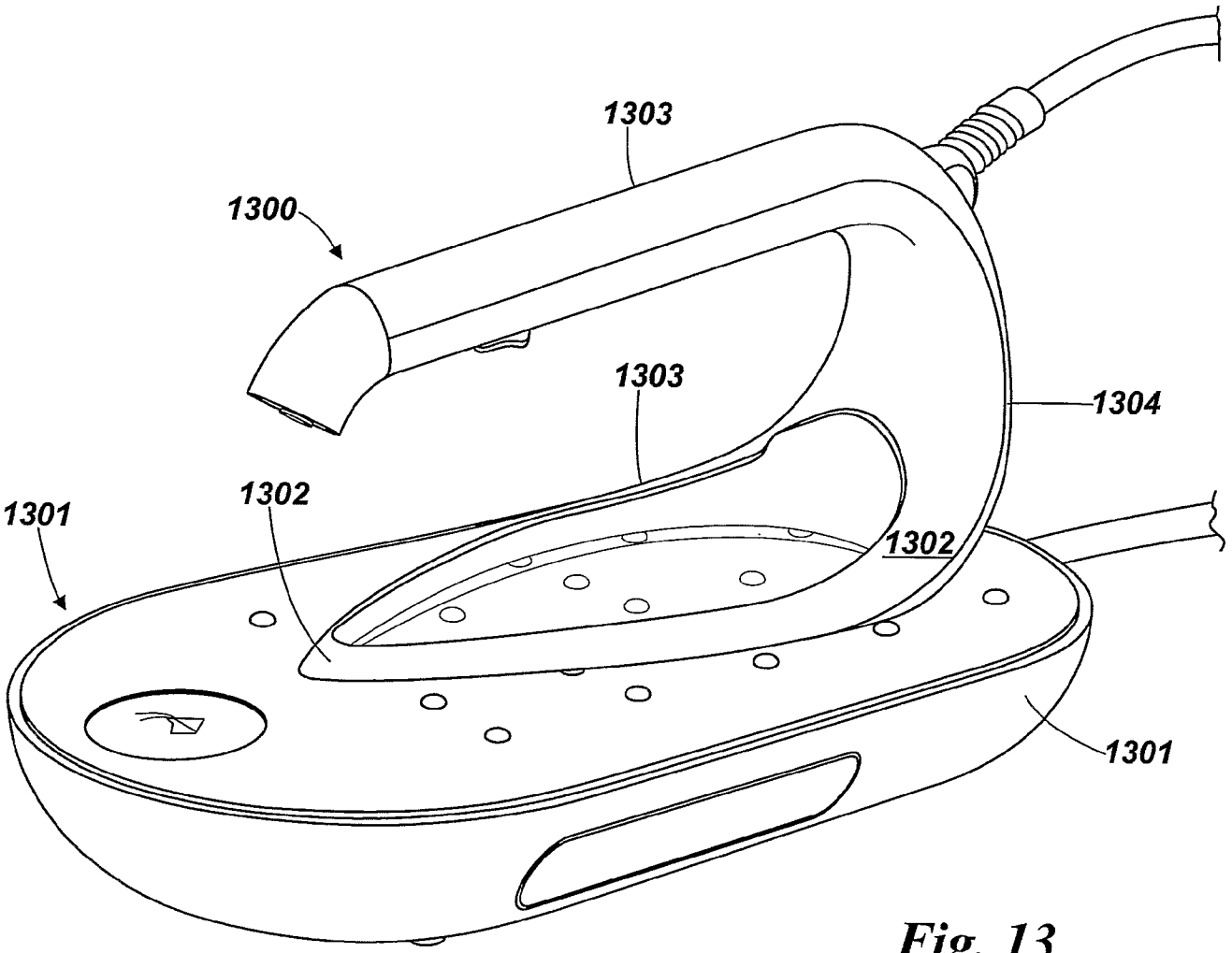
FIG. 13 illustrates schematically in perspective view an eighth iron according a tenth specific embodiment herein.

Referring to FIG. 13 herein, there is illustrated schematically in perspective view from one side and above, an eighth iron according to a tenth specific embodiment herein. The iron comprises a light weight electric hand iron component (1300), and a base component (1301) which also provides a reservoir for water supply to the hand iron.

The hand iron comprises a substantially transparent sole plate having a transparent or translucent thin film heating element, for example an antimony tin oxide heating element; an upper casing (1302) which surrounds a periphery of the sole plate and is positioned on top of the glass or ceramic sole plate, the casing curving up and being formed into a handle portion (1303) which lies parallel to and above the sole plate, with a gap there between allowing a user to grasp the handle; and positioned between the glass sole plate and the handle, a transparent upper casing portion (1303) which lies above the glass or ceramic sole plate. The handle is connected to the sole plate and upper casing by a rigid rear connecting portion (1304) and there is no connection between the front of the handle and the tip of the upper casing. The upper casing being transparent, allows the user to see through the casing, and through the glass sole plate to see the material being ironed directly underneath the glass sole plate. The substantially transparent upper casing (1303) also provides the function of protecting the users hand and fingers from the upper surface of the heated glass sole plate and thermally insulates the user from the heated glass sole plate.

A space or cavity between the convex shaped upper window (1303) and the substantially flat planar glass or ceramic sole plate may be filled with an inert or thermally insulating gas, in order to reduce the thermal conductivity between the glass sole plate and the window, or may be filled with air. The cavity may be sealed unit to prevent escape of the gas.

Figure 14:
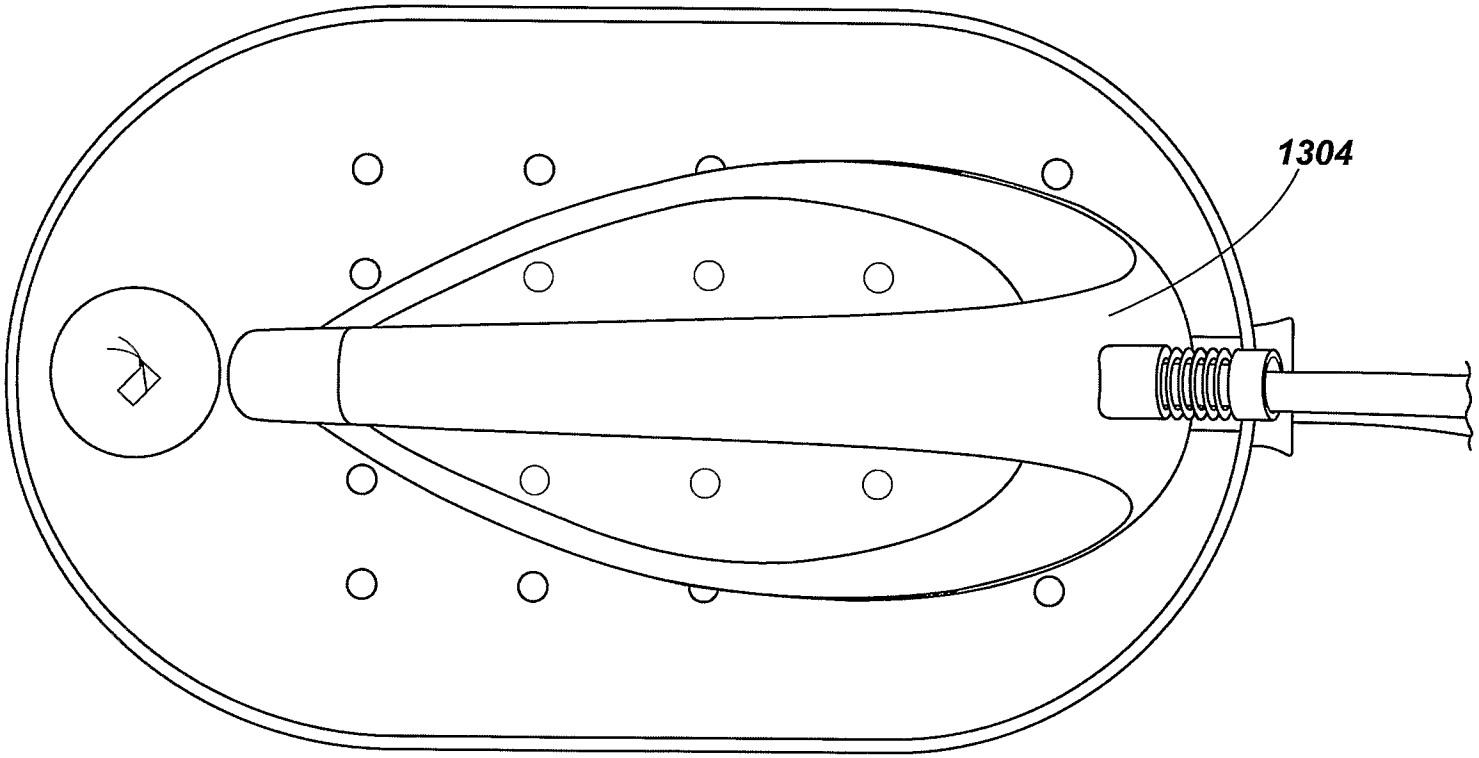
FIG. 14 illustrates schematically in view from above, the eighth iron as shown in FIG. 13 herein.

Referring to FIG. 14 herein, there is illustrated schematically the sixth iron and its base in view from above, showing how a user can see through the transparent upper cover, through the glass sole plate and underneath to the base unit. In the iron of FIGS. 13 and 14, water is sprayed from a position at the front of the iron, at the front of the handle, rather than through the glass sole plate. A vapour outlet may be provided at a front position of the iron, which emits water vapour or mist onto a region immediately in front of the tip of the sole plate. In the embodiment shown, the vapour outlet is positioned at the front of the handle, overhanging the tip of the sole plate, or alternatively through the face of the sole plate.

Figure 15:
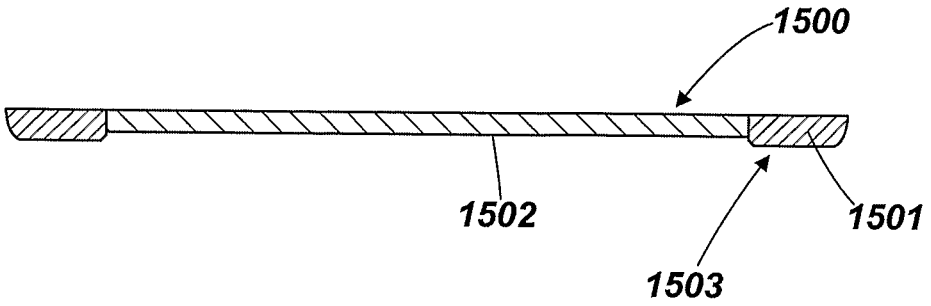
FIG. 15 herein illustrates schematically in cross sectional view a glass sole plate having a recessed glass plate surrounded by an aluminium outer rim or frame.
Figure 16:
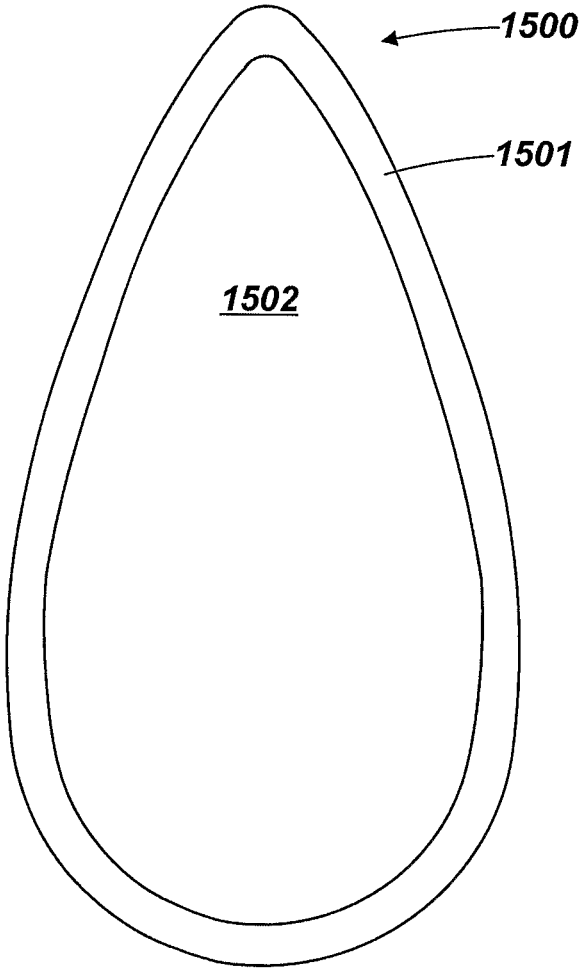
FIG. 16 herein illustrates in view form underneath a metal rimmed glass sole plate.

Referring to FIGS. 15 and 16 herein, there is illustrated schematically in cross sectional view, an alternative embodiment sole plate 1500 comprising a glass inner plate 1502 and an outer metal e.g. aluminium rim or frame 1501. The aluminium frame may provide shock resilience on dropping the iron accidentally. Sharp blows to the edge of the sole plate are absorbed by the aluminium edge which extends around a periphery of the glass sole plate. The glass or ceramic inner sole area 1502 is protected from direct impact in a direction along the plane of the sole plate, and from impact around the edge of the glass/ceramic portion.

Additionally, the glass/ceramic inner sole area 1502 is slightly recessed from the outer metal frame so that if the iron is accidentally dropped so as to land with the sole plate flat or near parallel to the floor, the inner glass/ceramic sole area 1502 is protected by the outer metal rim. In the best mode, the outer rim may project or protrude beyond the outer surface of the glass or ceramic portion by a distance of the order of up to 0.4 mm and preferably 0.2 to 03. mm. The exact amount of recess is determined as a trade off between the protecting the glass plate from impact, and the need to have the sole plate in contact with the surface to be ironed. The inner periphery 1503 of the rim or frame may be chamfered to provide a smooth transition to the glass portion of the sole plate. Other profiles of metal frame are possible, with the effect that a portion of the outer metal frame extending around the glass sole plate extends in a direction perpendicular to the planar surface of the glass sole portion by an offset distance of the order up to 0.4 mm, and preferably 0.2 to 0.3 mm beyond the outer cloth contacting plane of the glass sole portion.

Figure 17:
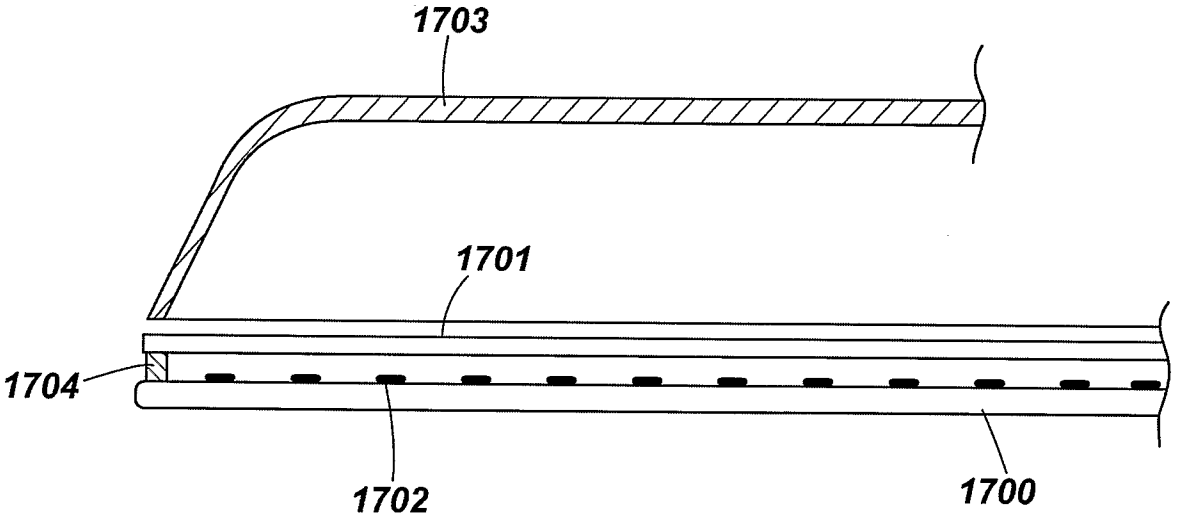
FIG. 17 herein shows in cross sectional view an embodiment of layers of a glass sole plate iron.

Referring to FIG. 17 herein, there is illustrated schematically in cut away view from one side an embodiment glass sole plate iron showing the layers of construction. A glass sole plate 1700 forms the underside of the iron. Spaced apart from and on top of the sole plate is an adjacent secondary layer 1701, with a gap between the sole plate and the secondary layer. The secondary layer is preferably transparent or see through, but in some embodiments may be opaque.

The secondary layer may form a sealed unit with the sole plate and an inert gas may be contained within the cavity between the sole plate and the secondary layer. The secondary layer provides thermal insulation and electrical insulation to the upper side of the sole plate onto which are formed the ATO heating elements 1702.

Over the secondary layer is formed a further cover layer 1703, which forms the upper part of the case. This layer is preferably transparent, but in some embodiments may be opaque. There is preferably an air gap between the upper layer 1703 and the secondary layer. The upper layer provides an acceptable touch temperature to the user, being thermally insulated form the secondary layer and the sole plate by an air gap. The upper cover layer may be formed of a heat resistant polymer material e.g. polycarbonate.

In this specification, where resistive heating elements, fuses or other semi-conductor components have been described utilising antimony tin oxide thin film, such components may be substituted by appropriately doped indium tin oxide (ITO) or fluorine tin oxide (FTO) coatings, as are known in the art or mixtures of such oxides.

It will be understood that the invention is not limited to the described embodiments and encompasses modifications apparent to those skilled in the art lying within the scope of the claims appended hereto.

The invention claimed is:

1. An iron comprising:

a sole plate adapted to communicate with a reservoir for containing water; and a secondary layer;

said sole plate comprising:

a transparent glass or ceramic substrate; and an electrical heating element formed on said glass or ceramic substrate, wherein said heating element comprises a substantially transparent film coating of conducting or semiconducting material; and said secondary layer disposed over said sole plate such that a thermally and electrically insulating gap is formed between said secondary layer and said sole plate, wherein said secondary layer is disposed over the glass or ceramic substrate and provides a thermal and electrical insulation barrier from said substrate, said secondary layer being a separate transparent glass or ceramic layer positioned adjacent to said substantially transparent film coating of conducting or semiconducting material, wherein said transparent secondary layer and said sole plate are arranged such that in use, a user can see through the secondary layer and the sole plate to see a fabric underneath the sole plate as the fabric is being ironed.

2. The iron according to claim 1, wherein said substantially transparent film coating comprises doped tin oxide.

3. The iron according to claim 1, wherein a vapour outlet is provided at a front of the iron, which emits water vapour or mist onto a region immediately in front of a tip of the sole plate or through a face of the sole plate onto a fabric to be ironed.

* * * * *